US006583104B1

(12) United States Patent
Christensen et al.

(10) Patent No.: US 6,583,104 B1
(45) Date of Patent: Jun. 24, 2003

(54) AQUEOUS CLEANING COMPOSITIONS

(75) Inventors: Scott Patrick Christensen, Charleston, WV (US); Christopher W. Derstine, Winfield, WV (US); Brian T. Keen, Charleston, WV (US)

(73) Assignee: Union Carbide Chemicals & Plastics Technology Corporation, Danbury, CT (US)

( * ) Notice: Subject to any disclaimer, the term of this patent is extended or adjusted under 35 U.S.C. 154(b) by 121 days.

(21) Appl. No.: 09/611,031

(22) Filed: Jul. 6, 2000

Related U.S. Application Data

(63) Continuation-in-part of application No. 09/226,449, filed on Jan. 6, 1999, now abandoned.

(51) Int. Cl.[7] ..... C11D 7/26; C11D 3/20; C11D 3/43

(52) U.S. Cl. ..... 510/506; 510/180; 510/238; 510/239; 510/240; 134/38; 134/39; 134/40

(58) Field of Search ..... 510/180, 238, 510/239, 240, 506; 134/38, 39, 40

(56) References Cited

U.S. PATENT DOCUMENTS

| | | | | | |
|---|---|---|---|---|---|
| 3,882,038 | A | * | 5/1975 | Clayton et al. | 510/421 |
| 4,983,317 | A | * | 1/1991 | Requejo et al. | 252/174.24 |
| 5,279,760 | A | * | 1/1994 | Sato et al. | 510/185 |
| 5,437,807 | A | * | 8/1995 | Garabedian, Jr. et al. | 510/427 |
| 5,538,664 | A | * | 7/1996 | Michael | 510/217 |

FOREIGN PATENT DOCUMENTS

| | | | |
|---|---|---|---|
| EP | 527625 | A2 * | 2/1993 |

* cited by examiner

*Primary Examiner*—Yogendra N. Gupta
*Assistant Examiner*—Brian P. Mruk

(57) ABSTRACT

Novel water-based cleaning compositions comprising:

(a) a surfactant component, (b) a solvent component comprising ethylene glycol pentyl ether which contains at least about 90% by weight of mono-ethylene, diethylene or triethylene glycol n-pentyl ether, and (c) water.

8 Claims, No Drawings

AQUEOUS CLEANING COMPOSITIONS

This application is a continuation-in-part of Ser. No. 09/226,449 filed on Jan. 6, 1999, now abandoned.

FIELD OF THE INVENTION

This invention relates to aqueous cleaning compositions which contain an organic solvent and are particularly useful in cleaning hard surfaces such as glass, ceramic tile and the like.

BACKGROUND OF THE INVENTION

Water-based hard surface cleaning compositions are well known, many having been disclosed in the literatures and a number have been sold commercially. Typically, such compositions contain a surfactant, an organic solvent or solvent system and water as well as a variety of other ingredients such as coupling agents, builders, alcohols, ammonia, pH modifiers, germicides, perfumes, opacifiers, dyes, etc. which may be chosen by the skilled formulator to satisfy the'requirements of a particular application.

It is well known that an organic solvent having excellent solvency for soils such as grease and wax needs to be present in water-based cleaning compositions to achieve acceptable results in cleaning hard surfaces such as glass, ceramic tile, etc. An appropriate organic solvent having good cleaning efficiency enhances an aqueous cleaning composition's ability to remove soils and dirt which may contain organic matter from the hard surface to be cleaned without leaving streaks or residues. However, because of recentregulatory efforts to reduce the presence of volatile organic compounds in products such as cleaning compositions which have significant exposure to the environment, the industry continues to look for more efficient solvent systems which can be used in smaller amounts while maintaining cleaning efficiency. In addition, for commercial acceptance, it is important that the organic solvent does not impart a strong or unpleasant odor to the cleaning composition.

Various glycol ethers, used alone or in combination with other organic solvents, have been recognized as a useful solvent component for aqueous cleaning compositions. For example, ethylene glycol butyl ether has been used as the solvent of choice in numerous commercial cleaning compositions for many years and is disclosed in prior art patents ( see, for example, U.S. Pat. No. 4,983,317). This glycol ether has acceptable cleaning efficiency and good solubility in water-based cleaning compositions. However, its cleaning, efficiency levels off at about 1% by weight in aqueous cleaning composition and, as the data in Table 1 shows, actually declines as more of the solvent is added thus limiting the cleaning efficiency which can be achieved by using this solvent alone.

European Patent Publication 0527625A2 discloses the use of up to about 1.5% ethylene glycol hexyl ether as a solvent in water-based cleaning compositions. This glycol ether has better cleaning efficiency than ethylene glycol butyl ether but is only soluble up to about 1% by weight in the water-based cleaning compositions thus requiring the use of coupling agents and/or cosolvents which may result in the presence of an undesirable level of volatile organics.

U.S. Pat. No. 3,882,038 discloses hard surface cleaning compositions containing certain classes of glycol ether compositions including those represented by the formula:

$$RO(C_2H_4O)_{\mu}H$$

wherein R is an alkyl group containing from 5 to 8 carbon atoms, and $\mu$ has a value of from 1 to 6, preferably 1 to 3, with the proviso that $\mu$ has a value of from 1 to 4 when R contains five carbon atoms, and $\mu$ has a value of 3 to 6 when R contains from 6 to 8 carbon atoms. This patent discloses a large number of glycol ethers which could be used as a solvent in water-based cleaning compositions including ethylene glycol amyl ether. This amyl ether product is shown by the patentee to have acceptable cleaning efficiency particularly when used with a coupling agent in water-based compositions containing a builder. The ethylene glycol amyl ether disclosed in U.S. Pat. No. 3,882,038 is typically prepared by the reaction of ethylene oxide and amyl alcohol. The "amyl" designation is understood by those knowledgeable in the art to be a mixture of isomers including 40 to 50% or more of the 2-methyl butyl isomer and up to 10% of the 3-methyl butyl isomer in addition to the n-pentyl species. The ethylene glycol amyl ether solvent, while offering an improvement in cleaning efficiency over ethylene glycol butyl ether solvent, has a strong odor and the presence of the 3-methyl butyl isomer creates potential toxicity problems making it unsuitable for commercial use. Thus amyl ether products such as that disclosed in U.S. Pat. No. 3,882,038 have never achieved acceptance in the marketplace for use as a solvent in water-based cleaning compositions.

SUMMARY OF THE INVENTION

According to the present invention, applicants have discovered that a specific ethylene glycol pentyl ether product is useful as a solvent component to provide improved water-based cleaning compositions. More specifically, the present invention relates to water-based cleaning compositions which comprise a surfactant, water and an organic solvent component comprising a predominately normal or straight chain ethylene glycol pentyl ether product containing at least about 90% by weight, based on the total weight of the ethylene glycol pentyl ether product of mono-ethylene, diethylene or triethylene glycol n-pentyl ether or mixtures thereof.

DESCRIPTION OF THE INVENTION

The water-based cleaning compositions of the present invention comprise (a) a surfactant component, (b) water and (c) a solvent component comprising an ethylene glycol pentyl ether product which contains at least about 90% by weight of mono-ethylene, diethylene or triethylene glycol n-pentyl ether. Particularly good results are obtained when the ethylene glycol pentyl ether product contains at least about 95% up to 99% or higher by weight of mono-ethylene, diethylene or triethylene glycol n-pentyl ether or mixtures thereof.

The unique properties that this specifically defined ethylene glycol n-pentyl ether product provides when used in water-based cleaning compositions have heretofore gone unrecognized in the art. The water-based cleaning compositions of applicants' invention exhibit unexpectedly improved cleaning efficiency compared to other glycol ethers while offering other properties necessary for commercial acceptance including acceptable odor characteristics and low toxicity.

In particular, it has been discovered that the water solubility of the ethylene glycol n-pentyl ether product used in the water-based cleaning compositions of the present invention is greater than expected and that suprisingly, its cleaning efficiency continues to increase as its concentration in a water-based cleaning composition increases to the saturation point, thus providing water-based cleaning compositions with cleaning efficiencies significantly superior to any previously known in the art. This effect is not seen with, for example, ethylene glycol butyl ether or ethylene glycol hexyl ether whose cleaning efficiency quickly passes through a maximum and then declines as concentration is increased. This suprising beneficial feature of the ethylene glycol n-pentyl ether solvent of the present invention allows the formulator to tune the cleaning performance of the cleaning compositions of the present invention by changing solvent concentration and to more easily balance cleaning performance with other desirable properties. The presence of higher amounts of the normal pentyl species in the ethylene glycol n-pentyl ether product used in the water-based cleaning compositions of the present invention, in addition to improving cleaning efficiency, results in other benefits such as better odor characteristics, less streaking, better cloud point control and low toxicity.

The ethylene glycol n-pentyl ether product containing at least about 90% by weight of mono-ethylene, diethylene or triethylene glycol n-pentyl ether may be obtained using known, processes and techniques. Such products are advantageously prepared by reacting pentanol containing at least about 90% n-pentanol with ethylene oxide in the presence of a basic or acidic catalyst until a product of the desired molecular weight is obtained. Pentanol containing at least about 90% n-pentanol may be prepared directly utilizing oxo technology disclosed in U.S. Pat. Nos. 3,527,809; 4,283,562; 4,593,011; 4,762,817; 4,769,498; 5,113,022; 5,180,854 and 5,364,950 or by refining a pentanol product containing more than 10% isomers. The ethylene glycol n-pentyl ether product used in the water-based cleaning compositions of the present invention contains minor amounts, i.e. less than 10%, of the 2-methylbutyl isomer but is otherwise essentially free of isomers including highly toxic species such as the 3-methylbutyl species.

The amount of the ethylene glycol n-pentyl ether product used in the water-based cleaning compositions of the present invention will vary depending on the type and amount of other ingredients present. The amount of the ethylene glycol n-pentyl ether used to achieve an optimum balance between cleaning efficiency and other properties such as cloud point while minimizing the overall amount of volatile organic compounds present can readily be determined by the skilled formulator. Typically, the ethylene glycol n-pentyl ether product will be present in an amount of from about 0.05 to about 10.0% by weight, based on the total weight of the cleaning composition. Particularly good results are obtained when the cleaning compositions of the present invention contain up to about 3.0% by weight of the mono-ethylene glycol n-pentyl ether product in alone or in combination with other solvents.

The water-based cleaning compositions of the present invention may contain other organic solvents in addition to the ethylene glycol n-pentyl ether product. Suitable compounds which may be useful as cosolvents are well known and may be selected from alcohols, glycols, glycol ethers, glycol ether esters, ketones, esters, and the like. Examples of such compounds include, without limitation, ethanol, propanol, isopropanol, butanol, glycol, ethylene glycol ethyl ether, ethylene glycol propyl ether, ethylene glycol butyl ether, ethylene glycol hexyl ether, diethylene glycol ethyl ether, diethylene glycol butyl ether, propylene glycol t-butyl ether and mixtures thereof.

Surfactants useful in the cleaning compositions of the present invention are well known and include anionic, nonionic and amphoteric compounds. Examples of such compounds are disclosed in U.S. Pat. Nos. 5,780,482 and 5,437,807 which are incorporated herein by reference. Combinations of more than one such surfactant compound may be used in the cleaning compositions of the present invention. Typically, the total amount of surfactant present in the water-based cleaning compositions of the present invention will be in the range of about 0.01 to about 5.0% by weight, based on the total weight of the composition.

The water-based cleaning compositions of this invention may include any of the well-known and conventional components used in such compositions. Such components include, for example, but without limitation, pH modifying agents, thickenings agents, anti-streaking agents, buffers, builders, chelating or sequestering agents, hydrotopes, antimicrobial agents, colorants, and perfumes. Selection and use of such components is well within the capabilities of the skilled formulator.

The amount of water present in the water-based cleaning compositions of this invention will depend upon the type and amount of other components present. Typically, the amount of water used in such compositions will be in the range of about 50 to about 99% by weight, based on the total weight of the composition. Selection of the appropriate amount of water and the manner in which the various components are combined to prepare the cleaning compositions of this invention are within the skill of a knowledgeable formulator.

EXAMPLES 1 TO 14

A series of hard surface cleaning compositions containing a surfactant component, a solvent component and water were prepared and tested for cleaning performance and cloud point. The surfactant component of all of the compositions tested was 0.5% by weight of TRITON® X-100 surfactant marketed by Union Carbide Corporation. The compositions tested contained varying amounts of the solvent component as shown in Table 1. The remainder of the compositions tested was water. The solvent component of the compositions representing the present invention is ethylene glycol pentyl ether (EGPE) containing 99% by weight of ethylene glycol n-pentyl ether. These compositions are compared in Table 1 with compositions having ethylene glycol butyl ether (EGBE) and ethylene glycol hexyl ether (EGHE) as solvent components.

Cleaning performance of the various compositions of Examples 1 to 14 was determined by the method of evaluating such performance described in European Patent Application no. 506087. This evaluation method determines quantitatively the ability of test cleaning solutions to remove a pigment-clay soil from synthetic floor tiles. The floor tile used in testing the compositions of Examples 1 to 14 is identified as Flexco, SV-50, 12"×12"×⅛" tiles cut to 3"×3" sections. The cloud point of the various compositions in Table 1 was determined using the Mettler Toledo FP900 System (FP90 Central Processor and FP81 Measuring Cell) for the measurements of temperature transitions. The control standard is based on a cleaning composition containing 2.5% by weight, based on the total weight of the composition, of ethylene glycol butyl ether (Butyl CELLOSOLVE® Solvent), 0.5% TERGITOL® Nonionic Surfactant NP-9 and the remainder water.

TABLE 1

| Ex. | Solvent | Cleaning Performance (Control = 1.0) | Cloud Point Temp. (° C.) |
|---|---|---|---|
| 1 | 0.5% EGPE | 1.17 | 62 |
| 2 | 1.0% EGPE | 1.18 | 55 |
| 3 | 1.5% EGPE | 1.35 | 49 |
| 4 | 2.0% EGPE | 1.46 | 41 |
| 5 | 2.5% EGPE | 1.54 | 34 |
| 6 | 3.0% EGPE | 1.83 | 27 |
| 7 | 1.0% EGBE | 1.09 | 68 |
| 8 | 2.0% EGBE | 1.09 | 69 |
| 9 | 3.0% EGBE | 1.12 | 68 |
| 10 | 4.0% EGBE | 0.97 | 66 |
| 11 | 5.0% EGBE | 0.87 | 64 |
| 12 | 0.5% EGHE | 1.34 | 39 |
| 13 | 0.75% EGHE | 1.42 | 25 |
| 14 | 1.0% EGHE | 1.27 | 16 |

From the data in Table 1, it can be seen that the cleaning performance of the compositions of Examples 1 to 6, which represent the compositions of the present invention, increase steadily with increased solvent concentration and offer significantly better cleaning performance compared to either ethylene glycol butyl ether or ethylene glycol hexyl ether.

EXAMPLES 15 TO 17

In these Examples, the cleaning performance of a hard surface cleaning composition of the present invention is compared to cleaning compositions having solvent components containing typical ethylene glycol amyl ether products. All of the compositions of Examples 15 to 17 contain 3.0% by weight, based on the total weight of the composition, of a solvent component, 0.5% by weight of TRINTON X-100 surfactant and the remainder water. In Example 15, the solvent component is ethylene glycol pentyl ether containing 99% n-pentyl ether. The solvent components in Example 16 and 17 are representative of ethylene glycol amyl ethers. The solvent of Example 16 contains 50% of the n-pentyl species and 50% of the 2-methyl butyl isomer while the solvent of Example 17 contains 60% of the n-pentyl species and 40% of the 2-methyl butyl isomer.

The cleaning efficiency of the compositions of Examples 15 to 17 was determined by the same procedure as in Examples 1 to 14 except that different tiles identified as Congoleum, Forum solids, SO-15, 12"×12"×⅛" tiles, cut to 3"×3" sections were used. The results of the cleaning tests are reported in Table 2.

TABLE 2

| Example | Solvent | Cleaning Performance Control = 1.0 |
|---|---|---|
| 15 | 3.0% EGPE | 1.65 |
| 16 | 3.0% Amyl 50/50 mix | 1.56 |
| 17 | 3.0% Amyl 60/40 mix | 1.56 |

The results in Table 2 show that the hard surface cleaning compositions of the present invention have unexpectedly high cleaning efficiency representing a 6% improvement over the compositions containing representative amyl ether solvents. In addition, the higher vapor pressure of the amyl ether solvent components results in a stronger odor for the compositions containing these solvents.

In addition to hard surface cleaning compositions, the n-pentyl glycol ethers of the present invention are useful as solvents in a variety of other applications including dyestuffs for the textile, leather and printing industries, industrial cleaning and specialty formulations, insecticides and herbicides, industrial coating systems such as conventional lacquers, enamels and stains, chemical rations, metal cleaners and degassers, paint and floor polish removers, high solids coatings, coalescing or filming aids in waterbourne emulsions or dispersions and hydraulic or brake fluids.

What is claimed is:

1. An aqueous cleaning composition comprising:

(a) a surfactant component, (b) a solvent component comprising ethylene glycol pentyl ether which contains at least 90% by weight of monoethylene glycol n-pentyl ether, diethylene glycol n-pentyl ether, triethylene glycol n-pentyl ether, or mixtures thereof and (c) water.

2. The composition of claim 1 wherein said surfactant component is an anionic compound, nonionic compound, amphotertic compound or mixtures thereof.

3. The composition of claim 1 wherein said ethylene glycol pentyl ether contains at least 95% monoethylene glycol n-pentyl ether, diethylene glycol n-pentyl ether, triethylene glycol n-pentyl ether or mixtures thereof.

4. The composition of claim 1 wherein said ethylene glycol pentyl ether contains at least 99% monoethylene glycol n-pentyl ether, diethylene glycol n-pentyl ether, triethylene glycol n-pentyl ether or mixtures thereof.

5. The composition of claim 1 wherein the surfactant component is present in an amount of from about 0.01 to about 5.0% by weight, based on the total weight of the composition.

6. The composition of claim 1 wherein said ethylene glycol pentyl ether is present in an amount of from about 0.05 to about 10.0% by weight.

7. The composition of claim 1 wherein said ethylene glycol pentyl ether contains at least 90% monoethylene glycol n-pentyl ether.

8. A method of improving the cleaning performance of a hard surface cleaning composition which comprises adding thereto an effective cleaning amount of an ethylene glycol pentyl ether which contains at least 90% by weight of monoethylene glycol n-pentyl ether, diethylene glycol n-pentyl ether, triethylene glycol n-pentyl ether or mixtures thereof.

* * * * *